US006047516A

United States Patent [19]

Taylor

[11] Patent Number: 6,047,516

[45] Date of Patent: Apr. 11, 2000

[54] REINFORCING MEANS

[76] Inventor: Roy G Taylor, 18 Truscott Avenue, Johnsonville, New Zealand

[21] Appl. No.: 08/995,787

[22] Filed: Dec. 22, 1997

[30] Foreign Application Priority Data

Dec. 23, 1996 [NZ] New Zealand ..... 299995

[51] Int. Cl.[7] ..... E04B 1/30

[52] U.S. Cl. ..... 52/715; 52/726.2; 52/730.7

[58] Field of Search ..... 52/712, 714, 715, 52/723, 726.2, 728, 729, 730.7, 731.1, 735

[56] References Cited

U.S. PATENT DOCUMENTS

| | | | |
|---|---|---|---|
| 3,673,671 | 7/1972 | Petersen | 52/715 X |
| 3,841,195 | 10/1974 | Jureit | 52/715 |
| 4,241,557 | 12/1980 | Jensen . | |
| 4,862,667 | 9/1989 | Melland . | |
| 5,006,006 | 4/1991 | Lehtonen | 52/712 X |
| 5,410,854 | 5/1995 | Kimmell et al. | 52/715 X |
| 5,452,556 | 9/1995 | Taylor . | |
| 5,497,595 | 3/1996 | Kalinin . | |
| 5,632,128 | 5/1997 | Agar | 52/715 X |
| 5,640,822 | 6/1997 | Haswell | 52/712 |
| 5,735,087 | 4/1998 | Olden | 52/715 X |
| 5,881,529 | 3/1999 | Rudd . | |

FOREIGN PATENT DOCUMENTS

| | | |
|---|---|---|
| 610618 | 4/1979 | Switzerland . |

*Primary Examiner*—Creighton Smith
*Attorney, Agent, or Firm*—Zarley, McKee Thomte, Voorhees & Sease

[57] ABSTRACT

With reference to FIG. 2, a preferred form of the invention comprises a reinforcing element for use in strengthening and stiffening wooden beams 6. The reinforcing element comprises a length of angles steel 1 attached to an offset nail plate 2. The angled steel 1 is laid against the wooden beam 6 and the nails 9 of the nail plate 2 are driven into the wooden beam 6. The reinforcing element may have a number of nail plates spaced along its length, or alternatively a single nail plate extending substantially along its entire length. In some modified forms of the reinforcing element 7 the nails 8 may extend from immediately behind the angled steel rather than from an offset plate.

7 Claims, 9 Drawing Sheets

REINFORCING MEANS

FIELD OF INVENTION

This invention relates to reinforcing means. In particular, one preferred form of the invention relates to reinforcing for wooden beams in building constructions.

BACKGROUND TO THE INVENTION

In the building industry designers and builders often face undesirable limitations on the span length possible with wooden beams. It is accordingly an object of at least one form of the present invention to provide means for strengthening and or stiffening wooden beams so that they can be used over relatively long spans.

GENERAL DESCRIPTION OF THE INVENTION

According to one aspect of the invention there is provided reinforcing means, comprising a substantially metallic elongate member and a plurality of teeth, the reinforcing means being constructed such that when it is in use the teeth can be forced into a wooden beam so that the elongate member extends along the beam and is securely held against the beam by way of the teeth with the result that the reinforcing means substantially strengthens and or stiffens the beam by way of actual or potential composite flexural action of the elongate member and the beam.

Optionally the reinforcing means comprises an end plate at an end of the elongate member, the end plate being formed such that when the reinforcing means is in use the end plate can receive a fixing member for securing the reinforcing means to a structural support or to a second substantially identical reinforcing means.

Preferably the fastener plate is substantially offset with respect to the elongate member.

Conveniently the teeth extend from the fastener plate.

According to a further aspect of the invention there is provided reinforcing means, comprising a substantially metallic elongate member, a fastener plate attached to the elongate member and being substantially offset with respect to the elongate member, and a plurality of teeth extending from the fastener plate, the reinforcing means being constructed such that when it is in use the teeth can be forced into a wooden beam so that the elongate member extends along the beam and is securely held against the beam by way of the teeth with the result that the reinforcing means substantially strengthens and or stiffens the beam.

DESCRIPTION OF THE DRAWINGS

Some preferred forms of the invention will now be described by way of example, and with reference to the accompanying drawings, of which.

DETAILED DESCRIPTION

Figure 1:
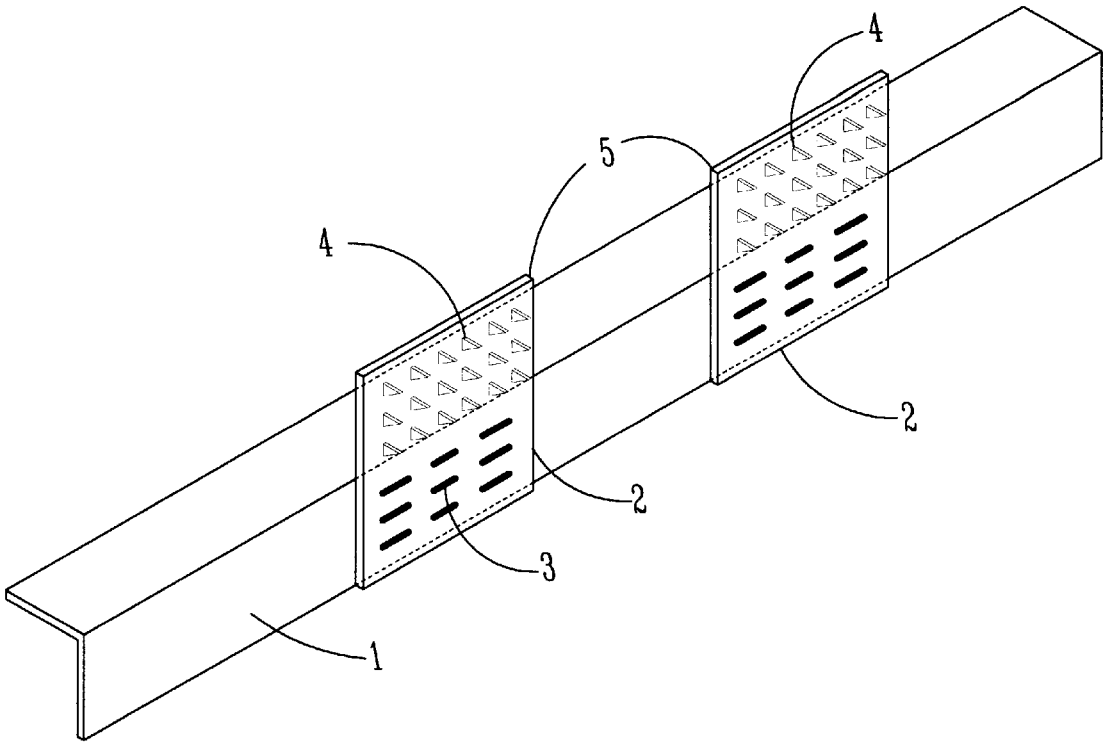
FIG. 1 is a perspective view of a reinforcing element for use with wooden beams or the like, FIG. 2 is a cross section view showing the reinforcing element in association with other similar elements and wooden beams.

With reference to FIG. 1, the reinforcing element preferably comprises a length of steel 1 with a substantially "L" shape cross section. The reinforcing element has a plurality of nail plates 2 which are attached to the length of steel by spot welding 3 or some other suitable means. The nail plates 2 may be of a "knuckle" type with nail parts which can be driven into a wooden beam with a hammer. Optionally, the nail plates 2 may be of a "Clawnail" or "Gangnail" type where they can be fixed to a timber beam with a press or impact hammer. When the reinforcing element is in use outward extending parts 4 of the nail plates are driven against a wooden beam which is to be reinforced. In this way the reinforcing element is securely attached to the wooden beam, and such attachment may take place either in a workshop or on site. As shown in FIG. 1, the nail plates 2 are preferably spaced from one another by an appropriate distance 5. The actual spacing distance 5 may depend on requisite shear transfer across the wooden beam/reinforcing element interface. In some embodiments of the invention there may be a single nail plate extending substantially the entire length of the length of steel 1, rather than there being a number of smaller spaced nail plates 2.

Figure 2:
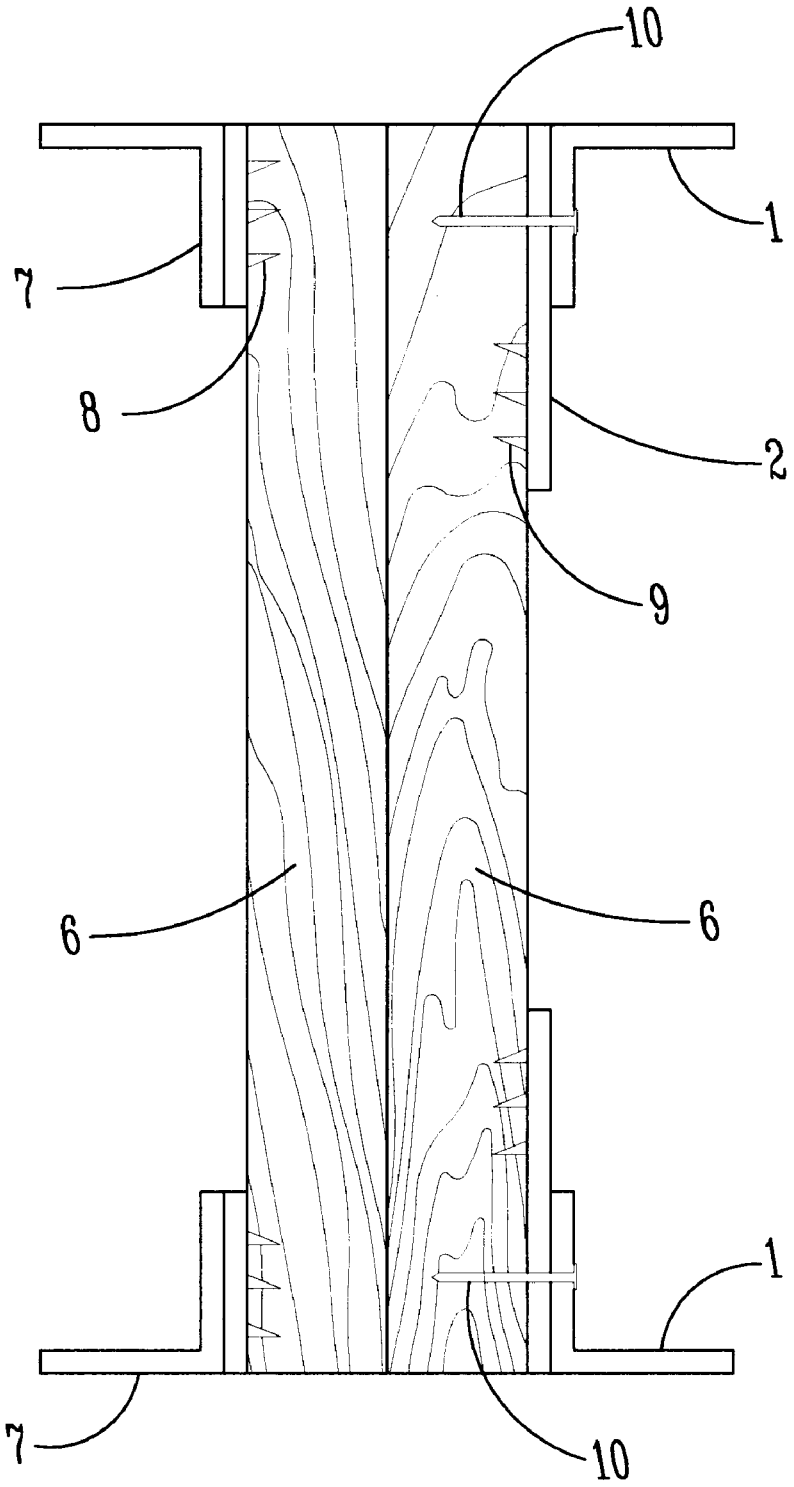

With reference to FIG. 2, there is shown an arrangement of two beams 6 laying against one another and strengthened by two reinforcing elements as described above, together with two modified reinforcing elements 7. The modified reinforcing elements 7 differ from those described previously in that they are "claw-like" with their teeth 8 extending from immediately behind the corresponding length of steel. The teeth of the modified reinforcing elements 7 can be forced into the respective beam 6 with the use of a suitable press. As can be seen from FIG. 2, the nail plates 2 of the unmodified reinforcing elements are arranged such that their teeth 9 are offset from the corresponding length of steel 1. This enables the teeth 9 to be readily driven into the corresponding wooden beam by way of a hammer. A nail or screw 10 extends through each nail plate 2 and its corresponding length of steel 1 to prevent sideways buckling of the length of steel 1.

Figure 3A:
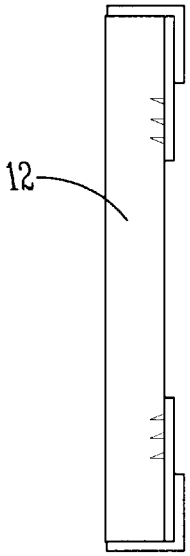
FIGS. 3A, 3B, 3C, 3D, 3E, and 3F are cross section views that show various applications of the reinforcing element of FIG. 1 (cross-hatching has been omitted)
Figure 3B:
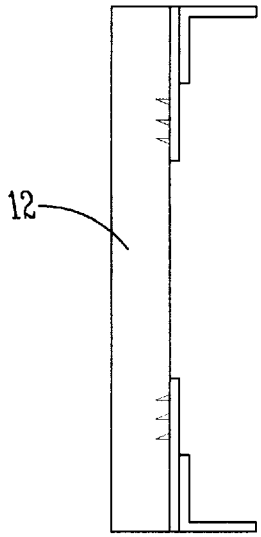
Figure 3C:
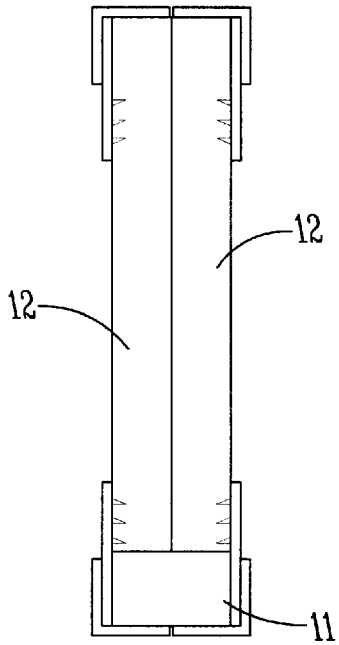
Figure 3D:
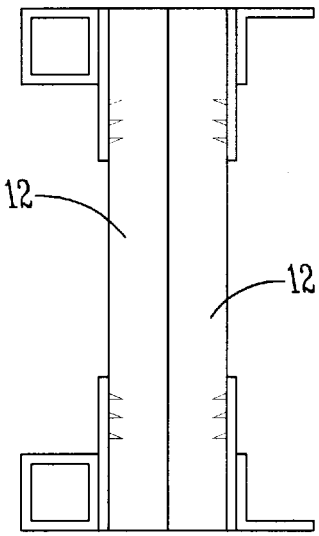
Figure 3E:
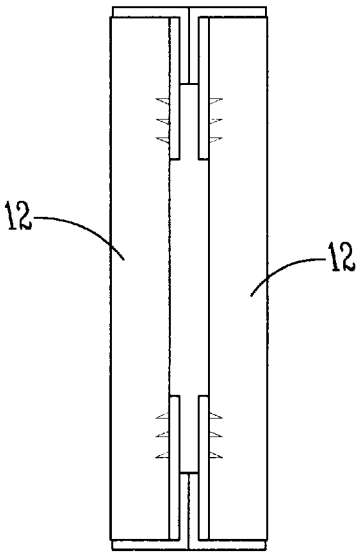
Figure 3F:
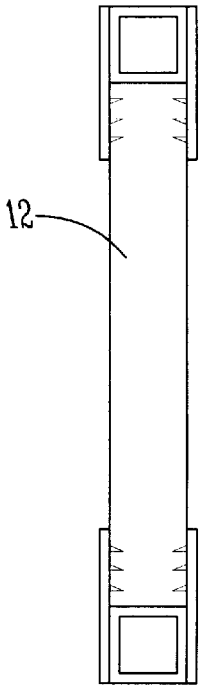

With reference to FIGS. 3A, 3B, 3C, 3E, and 3F, there is shown various arrangements of reinforcing elements as described above, as well as of further modified forms. In particular, FIG. 3A shows reinforcing elements nested around and recessed into corner parts of a wooden beam. FIG. 3C shows an arrangement for strong deep span beams wherein a timber beam 11 may be placed underneath two or more timber beams 12 which face one another. This arrangement may serve to increase effective timber size in construction. A similar but modified arrangement can be used where a timber beam as at 11 is placed beneath only one other beam as at 12. Referring to FIGS. 3D and 3F, there is shown an arrangement involving square section, rather than "L" section, lengths of steel.

Figure 4A:
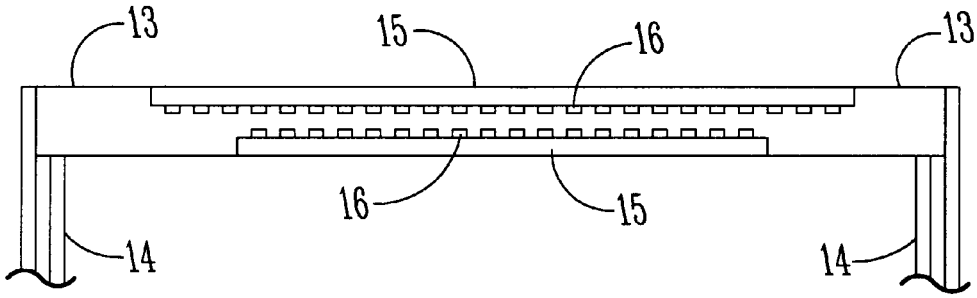
FIG. 4A is a partial front elevation view that shows a reinforced beam extending between two upright supports.
Figure 4B:
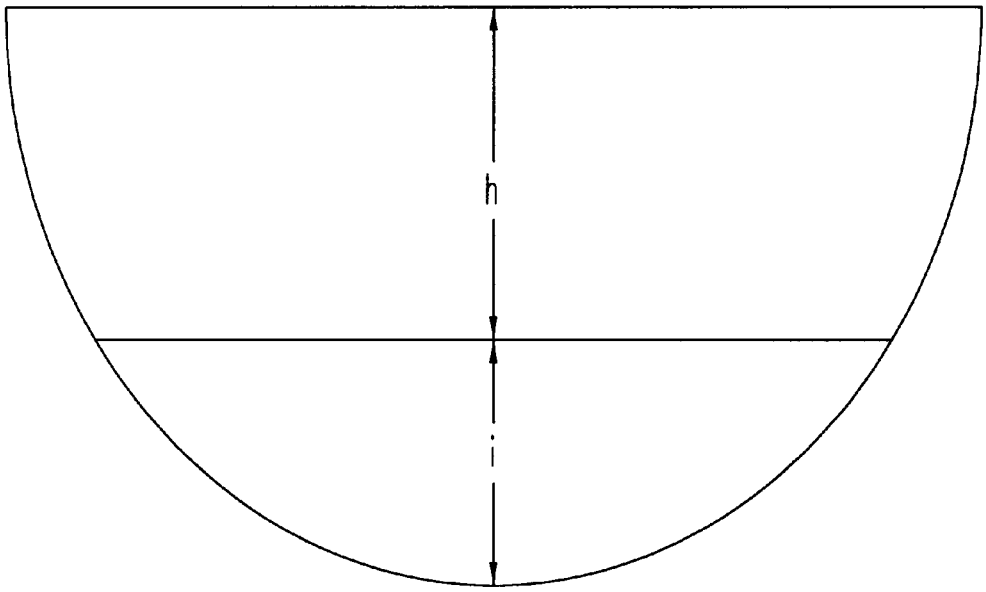
FIG. 4B is a bending moment diagram corresponding to the beam of FIG. 4A that shows the increased bending moment resistance achieved by the present invention.

With reference to FIG. 4A, there is shown a timber beam 13 extending between two spaced upright supports 14. The beam 13 is strengthened by two reinforcing elements 15 similar to that described with reference to FIG. 1, except that they are longer and have a greater number of nail plates 16. As can be seen, the reinforcing elements 15 run along part of the mid section of the beam 13. More particularly, one of the reinforcing elements 15 is secured to the upper edge of the beam 13 and the other to the lower edge of the beam 13. The reinforcing elements need not extend the complete distance between the two upright supports 14, although they can of-course be adapted to do so if that is desirable. FIG. 4B illustrates a possible bending moment diagram over the length of the wooden beam 13. The beam 13, when it is not reinforced, may be able to resist the bending moment indicated at "H". The reinforcing elements 15 provide for an effective bending moment which is increased by the amount indicated at "I". In at least some building arrangements reinforcing elements such as those described above may be placed at only strategic parts of timber beam constructions in order to reduce building costs.

Figure 5A:
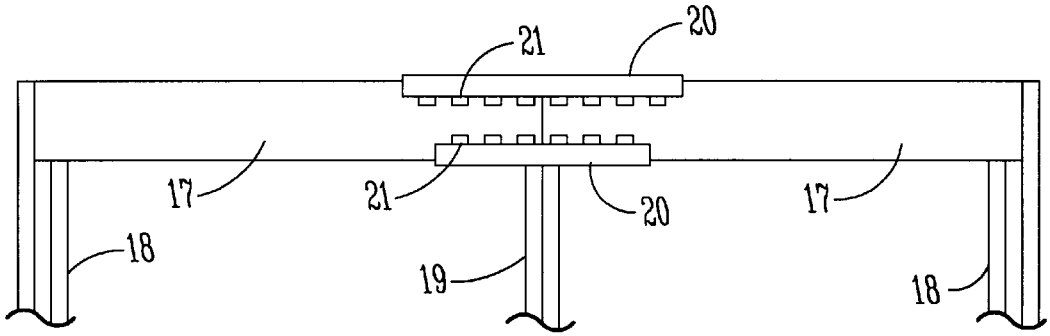
FIG. 5A is a partial front elevation view that shows a reinforced beam extending across three upright supports.
Figure 5B:
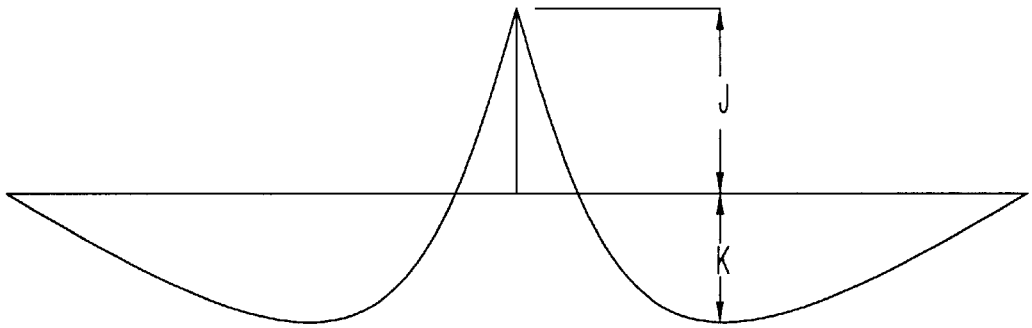
FIG. 5B is a bending moment diagram corresponding to the beam of FIG. 5A.

With reference to FIG. 5A, there is shown an arrangement of two wooden beams 17 joined end to end so that they extend between two upright supports 18. There is also a third upright support 19 at the point where the two beams 17 are joined to one another. As shown, the two beams 17 are joined by upper and lower reinforcing elements 20 similar to those described with reference to FIG. 4A. More particularly, the reinforcing elements 20 are each fixed to both beams 17 by way of nail plates 21, and overlap the point where the beams 17 are in end to end contact with one another. FIG. 5B shows a bending moment profile corresponding to the FIG. 5A arrangement. The bending moment indicated at "J" corresponds to the moment carried by the reinforcing elements 20, and the amount indicated at "K" corresponds with the bending moment contribution remaining in the beams 17.

Figure 6A:
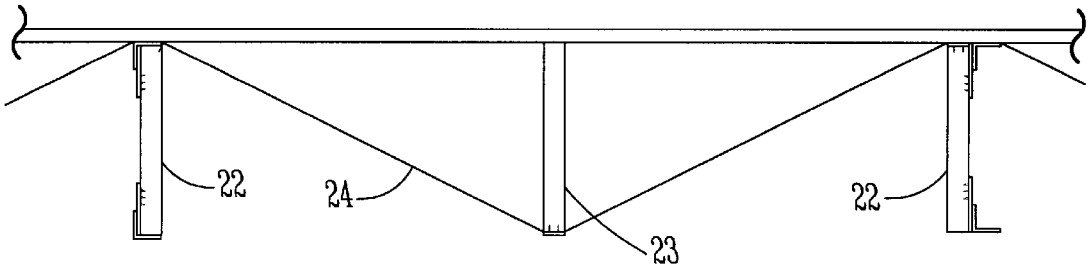
FIG. 6A is a cross section view of the midspan of a beam combination formed with the reinforcing means of this invention.
Figure 6B:
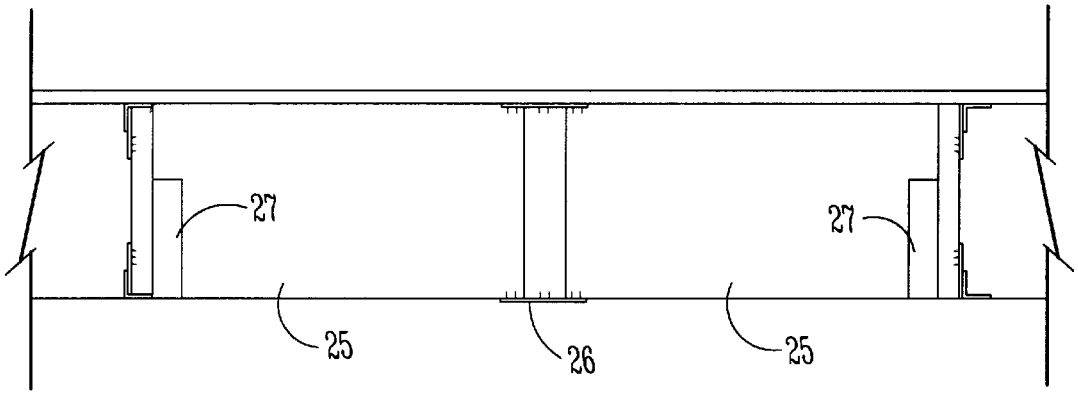
FIG. 6B is a cross section view similar to FIG. 6A showing another beam combination formed with the reinforcing means of this invention.

FIGS. 6A and 6B show further arrangements and applications for reinforcing elements similar or identical to those described previously. The use of the reinforcing elements serves to enable extended wooden beam spans. Economies may be obtained by using an alternating arrangement of timber beam/reinforcing unit combinations together with conventional timber joists 23. Some load may be transferred from the conventional timber joists 23 at their midspan by way of a steel strap 24 (FIG. 6A) or timber blocking 25 (FIG. 6B). If desired, the blocking may have nail plates 26 and/or joist hangers 27.

When using reinforcing elements with timber beams as described previously, the beams may be pre-flexed. This is preferably done before applying the reinforcing elements. The individual beams and the reinforcing elements are then arranged to form a composite beam which is released to produce a "locked in" camber. The camber may be used to offset dead load deflections and live load deformations, thus facilitating economical building designs.

Figure 7:
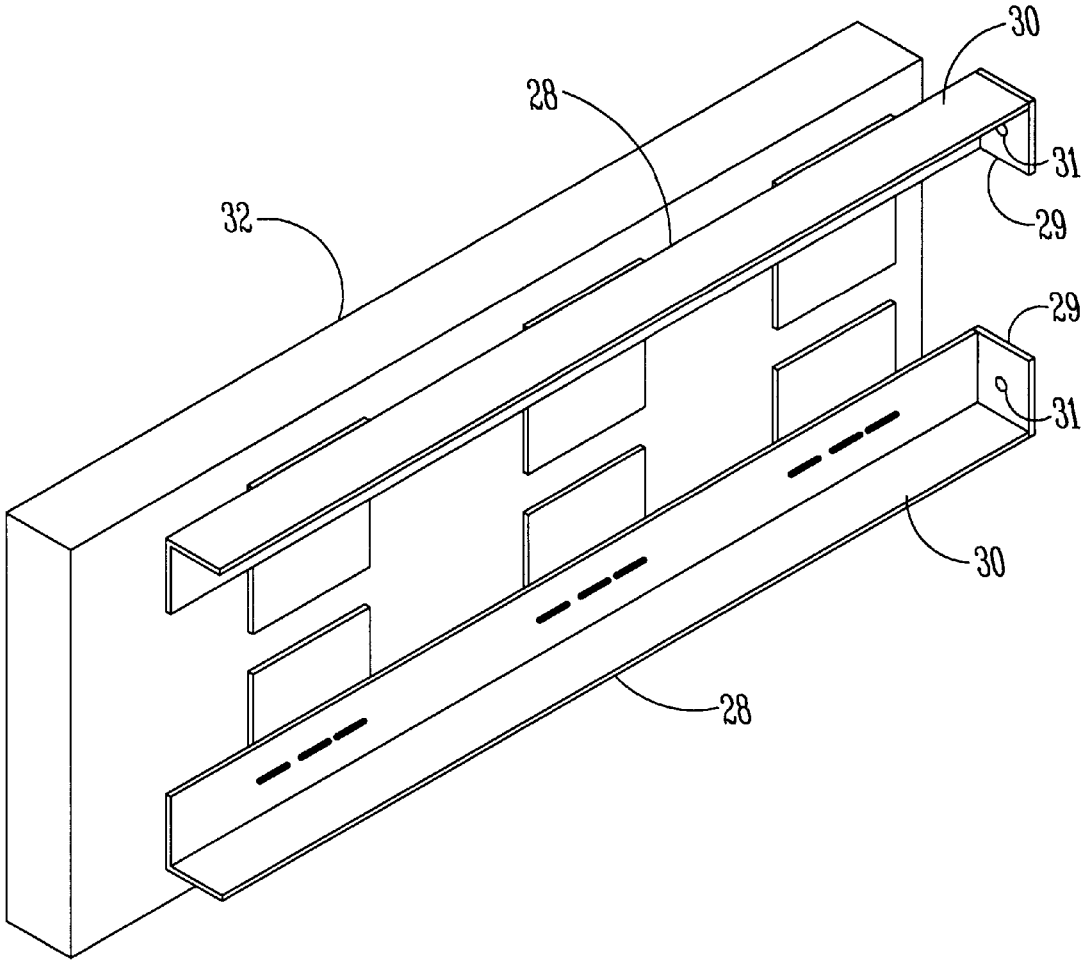
FIG. 7 is a perspective view of another beam and reinforcing means combination possible with this invention.

FIG. 7 shows a reinforcing element 28 similar to that described with reference to FIG. 1, except that it has end plates 29 between the two arms of the "L" shape length of steel 30. As can be seen in FIG. 7, the end plate 29 is a substantially square shape and has a central hole 31 extending therethrough. The holes 31 of the end plates 29 are used in attaching the ends of associated timber beams 32 to a suitable structural end support.

Figure 8A:
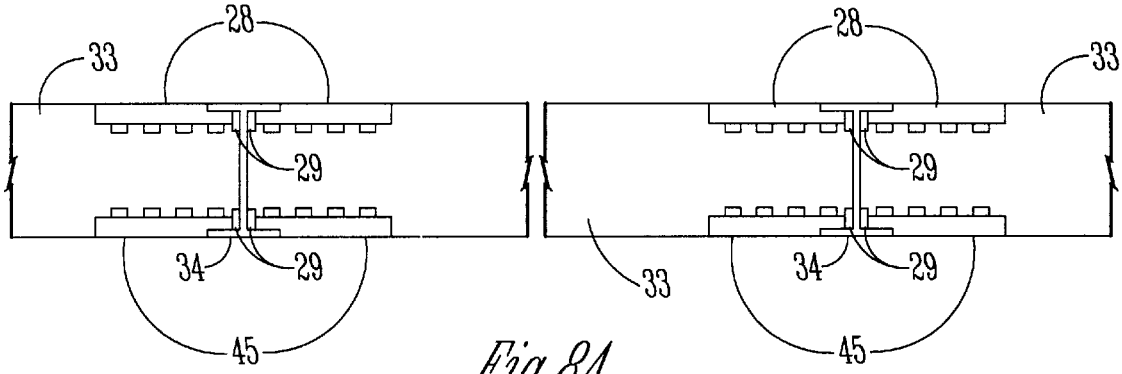
FIG. 8A is an elevation view that shows an elongated beam formed by a plurality of individual beams joined together using the reinforcing means of this invention.

FIG. 8A shows a "continuous" timber beam arrangement formed by using reinforcing elements 28 as described in FIG. 7, together with a plurality of beams 33 and end supports 34. The end plates 29 of the reinforcing elements 28 are bolted to the respective end supports 34 using the associated end plate holes 31.

Figure 8B:
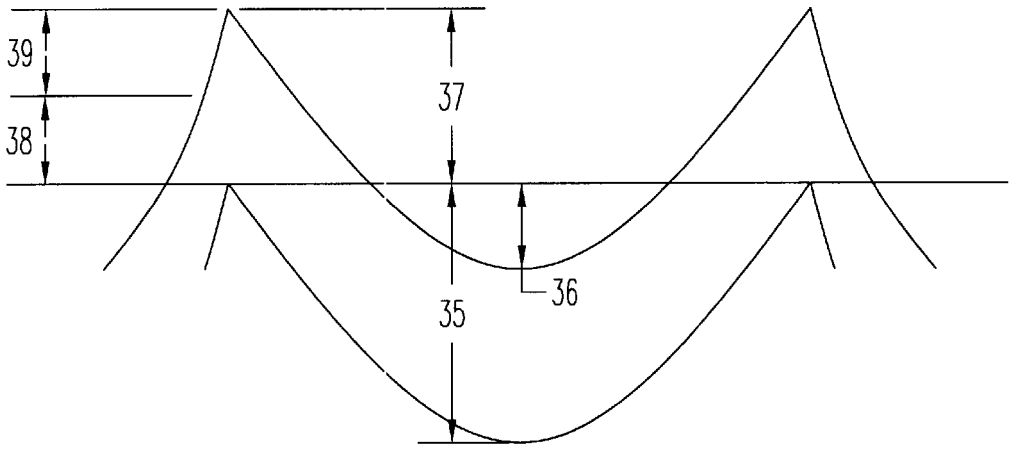
FIG. 8B is a bending moment diagram corresponding to the elongated beam of FIG. 8A that shows the increased bending moment resistance achieved by the present invention.

FIG. 8B is a bending moment profile, where the lower line corresponds to the continuous beam without the reinforcing elements 28, and where the upper line corresponds to the continuous beam when the reinforcing elements are used. It will be appreciated by those skilled in the art that the reinforcing elements significantly reduce the maximum midspan bending moment indicated at 35. The midspan moment indicated at 36 may be half that indicated at 35. Additionally, an increased fixed end bending moment may apply as indicated at 37. The timber beams 33 may be proportioned to resist a part 38 of the end bending moment 37 with the balance 39 carried by the reinforcing elements 28. The use of the reinforcing elements 28 may be curtailed when the bending moment near the end supports 34 reduces below 38 such that the beams 33 may carry it.

Figure 8C:
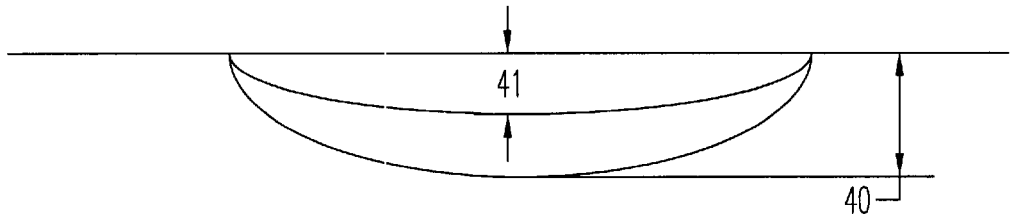
FIG. 8C is a diagram that shows the reduced deflection possible wiht the elongated reinforced beam of FIG. 8A.

FIG. 8C is a deflection profile corresponding to the FIG. 8A arrangement, showing curves when the reinforcing elements 28 are present, and also when they are not present. It will be understood by those skilled in the art that the use of the reinforcing elements 28 can significantly and favorably alter the deflection profile.

Figure 9A:
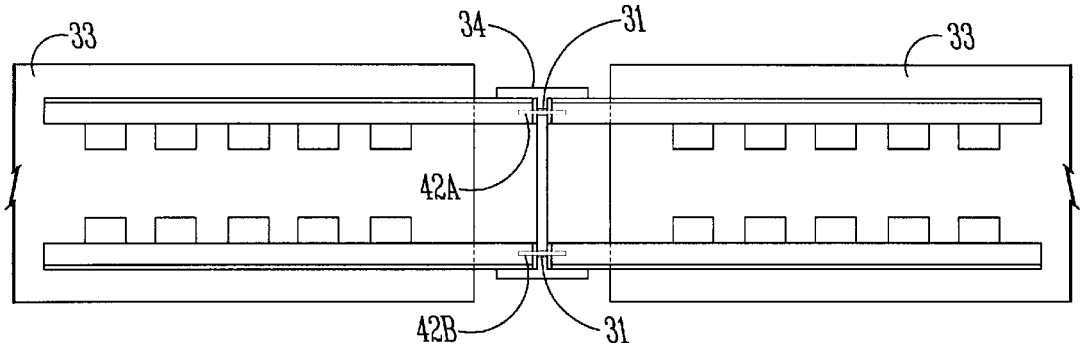
FIG. 9A is a side elevation view that shows the joint between the individual beams of FIG. 8 in a greater detail.
Figure 9B:
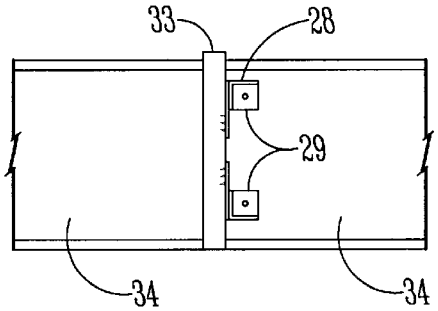
FIG. 9B is a cross section view taken at the joint in FIG. 9A.

FIG. 9A shows end detail of an arrangement as described with reference to FIG. 8A. It can be seen from FIG. 9A hat respective end plates 29 of the reinforcing elements 28 are secured to the end supports 34 by way of bolts 42A and 42B extending through the end plate holes 31. The arrangement is such that the associated wooden beams 33 are spaced slightly apart. The reinforcing elements 28 carry flexural actions of the wooden beams 33 as well as shears to the end supports 34. The upper bolts 42A and the end plates through which they pass may be arranged such that there is a gap between these end plates and the associated end supports 34. The gap may be for example 5–10 mm. The upper bolts 42A can then be tightened as appropriate to flex the wooden beams 33 upwards, thereby introducing an upward camber. The camber may serve to offset dead and live load deflections. Washers may be used over the bolts 42A and 42B to space the reinforcing elements 28 off the end supports 34, and thus facilitate a predetermined camber when the bolts 42A are tightened. FIG. 9B illustrates a section taken through the arrangement of FIG. 9A.

Figure 10:
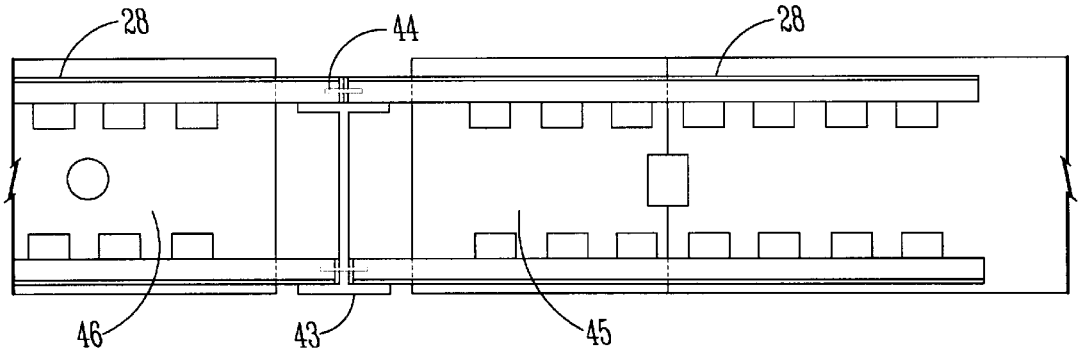
FIG. 10 is a side elevation view of a modified arrangment similar to FIG. 9A.

FIG. 10 shows a modified arrangement similar although not quite the same as that shown in FIGS. 9A and 9B. In the FIG. 10 arrangement it can be seen that some of the reinforcing elements 28 rest on top of an upright end support 43 and are connected to one another by way of a bolt 44 extending through their abutting end plates. In an alternative arrangement the bolt may extend through a plate extending upwards from the end support 43. The reinforcing elements 28 may be secured so that there is a space between the associated wooden beams 45 and 46.

A particular useful aspect of the present invention is that it can be "retro-fitted" to provide strength and stiffness to wooden beams which already form part of a house or some other construction. Additionally, retro-fitting can be undertaken to produce a camber in the beam. This can be achieved by exerting an upward pressure on a central part of the beam, subsequently combining a reinforcing element with the beam, and then relaxing the upward force with the effect that the reinforcing means maintains the camber.

It is important to appreciate that the reinforcing elements described with reference to the accompanying drawings can combine with wooden beams to achieve composite flexural action of timber and steel. This is of significant importance as it serves to produce a substantial enhancement of the strength and stiffness of the associated wooden beams. The reinforcing elements are, for example, significantly distinguishable from simple nail plates because simple nail plates do not have the strength, dimensions or form to enable composite action with substantial strengthening and or stiffening of a wooden beam.

While some preferred forms of the invention have been described by way of example, it should be appreciated that modifications and improvements can occur without departing from the scope of the appended claims.

I claim:

1. In combination, a wooden beam having a directly supported portion and an indirectly supported portion remote from the directly supported portion such that the indirectly supported portion is actually or potentially subjected to significant bending moments; and a reinforcing member, the reinforcing member comprising:

a substantially rigid non-wooden bar elongate member; the reinforcing member having teeth protruding therefrom that engage the indirectly supported portion of beam and thereby secure the reinforcing member in a position on the beam wherein the elongate member extends in a generally longitudinal direction along the beam and the indirectly supported portion of the beam; wherein the reinforcing member substantially strengthens or stiffens the beam by way of actual or potential composite flexural action of the elongate member and the beam such that the ability of the beam to resist a bending moment in the indirectly supported portion is significantly increased, the elongate member having an elongated main body portion with a plurality of longitudinally spaced fastener plate members cantilevered to and extending laterally beyond the elongate member, the teeth extending from the fastener plate members.

2. The combination of claim 1 wherein the fastener plate members are substantially flat and each have a first planar surface directed toward the wooden beam with the teeth formed on the first planar surface.

3. In combination, a wooden beam having a directly supported portion and an indirectly supported portion remote from the directly supported portion such that the indirectly supported portion is actually or potentially subjected to significant bending moments; and a reinforcing member, the reinforcing member comprising:

a substantially rigid non-wooden bar elongate member; the reinforcing member having teeth protruding therefrom that engage the indirectly supported portion of beam and thereby secure the reinforcing member in a position on the beam wherein the elongate member extends in a generally longitudinal direction along the beam and the indirectly supported portion of the beam; wherein the reinforcing member substantially strengthens or stiffens the beam by way of actual or potential composite flexural action of the elongate member and the beam such that the ability of the beam to resist a bending moment in the indirectly supported portion is significantly increased, the elongate member having a main body member that has a substantially L-shape or a substantially rectangular or a substantially square transverse cross-section.

4. The combination of claim 3, wherein the wooden beam comprises a beam assembly formed of two individual wooden beams each having opposite ends, the wooden beams being placed end to end and fastened together by the reinforcing member.

5. The combination of claim 4 wherein the elongate member has opposite ends and a generally transverse end plate formed at one of the ends of the elongate member such that when the reinforcing member is in use, the end plate receives a fixing member to secure the reinforcing member to a structural support or to a second substantially identical reinforcing member.

6. The combination of claim 5 wherein the beam is at least temporarily subjected to an upward camber that has been formed in the beam by securing the reinforcing member to the structural support or to the second substantially identical reinforcing member, and adjusting the fixing member in the end plate to manipulate tension in the beam assembly until the beam is at least temporarily subjected to the upward chamber.

7. In combination, a wooden beam having a directly supported portion and an indirectly supported portion remote from the directly supported portion such that the indirectly supported portion is actually or potentially subjected to significant bending moments; and a reinforcing member, the reinforcing member comprising:

a substantially rigid non-wooden bar elongate member; the reinforcing member having teeth protruding therefrom that engage the indirectly supported portion of beam and thereby secure the reinforcing member in a position on the beam wherein the elongate member extends in a generally longitudinal direction along the beam and the indirectly supported portion of the beam; wherein the reinforcing member substantially strengthens or stiffens the beam by way of actual or potential composite flexural action of the elongate member and the beam such that the ability of the beam to resist a bending moment in the indirectly supported portion is significantly increased, the elongate member having opposite ends and a generally transverse end plate formed at one of the ends of the elongate member such that when the reinforcing member is in use, the end plate receives a fixing member to secure the reinforcing member to a structural support or to a second substantially identical reinforcing member.

* * * * *